US008277070B1

(12) United States Patent
Schwarz

(10) Patent No.: US 8,277,070 B1
(45) Date of Patent: Oct. 2, 2012

(54) COUNTER WITH BORDER LIGHTING

(75) Inventor: Joseph R. Schwarz, Genoa City, WI (US)

(73) Assignee: Crafted Countertops, Inc., Genoa City, WI (US)

( * ) Notice: Subject to any disclaimer, the term of this patent is extended or adjusted under 35 U.S.C. 154(b) by 319 days.

(21) Appl. No.: 12/620,465

(22) Filed: Nov. 17, 2009

(51) Int. Cl.
*F21V 3/02* (2006.01)
*A47B 96/18* (2006.01)
*E03C 1/33* (2006.01)

(52) U.S. Cl. ... 362/133; 362/101; 362/134; 362/311.13; 362/311.14; 4/631; 4/638; 312/140.1

(58) Field of Classification Search ..... 362/133, 362/134, 145, 152, 234, 311.14, 96, 101, 362/311.13; 4/631–636, 638, 660; 312/140.1, 312/140.4, 210, 228
See application file for complete search history.

(56) References Cited

U.S. PATENT DOCUMENTS

| | | | | |
|---|---|---|---|---|
| 2,247,969 | A | 7/1941 | Stewart | |
| 4,756,951 | A | 7/1988 | Wang et al. | |
| 4,807,095 | A | 2/1989 | Bell | |
| 4,951,181 | A * | 8/1990 | Phillips | 362/134 |
| 5,045,978 | A * | 9/1991 | Gargle | 362/101 |
| 5,530,628 | A | 6/1996 | Ngai | |
| 6,468,677 | B1 | 10/2002 | Benton et al. | |
| 6,641,283 | B1 | 11/2003 | Bohler | |
| 6,886,958 | B1 | 5/2005 | Grant | |
| 6,957,452 | B2 | 10/2005 | Grant | |
| 7,141,287 | B2 | 11/2006 | Blessing | |
| 7,377,661 | B2 * | 5/2008 | Douglass | 362/101 |
| 7,413,321 | B2 | 8/2008 | Kim | |
| 7,494,258 | B2 | 2/2009 | McNaught | |
| 2005/0142968 | A1 | 6/2005 | Cushing et al. | |
| 2005/0276957 | A1 | 12/2005 | Runkel | |
| 2006/0046034 | A1 | 3/2006 | Schober | |
| 2006/0077652 | A1 * | 4/2006 | Theus | 362/96 |
| 2006/0147655 | A1 | 7/2006 | Schober | |
| 2006/0157184 | A1 | 7/2006 | Blessing | |
| 2006/0198128 | A1 | 9/2006 | Piepgras et al. | |
| 2007/0217199 | A1 | 9/2007 | Adam et al. | |
| 2008/0019121 | A1 | 1/2008 | Ly | |
| 2008/0236453 | A1 | 10/2008 | Ford | |

OTHER PUBLICATIONS

McGraw Hill Construction Publication Abstract, "Illuminated Countertops," http://construction.ecnext.com/coms.summary, one sheet (Dec. 1, 2007).
Cohen, "Fiber Optic Concrete Countertops—How to Add Magic to Cast Concrete Counters with Fiber Optic Lighting," www.concretenetwork.com, four sheets (Jun. 9, 2009).
Promotional brochure, "Illuminated Bar Countertop," www.avaliving.com, one sheet (Jun. 9, 2009).
Photograph of illuminated countertop, www.concretenetwork.com, one sheet (Jun. 9, 2009).
Construction guide, "Fiber Optic Concrete Countertops," www.fiberopticproducts.com, five sheets (Jun. 9, 2009).

(Continued)

*Primary Examiner* — Alan Cariaso
(74) *Attorney, Agent, or Firm* — Lempia Summerfield Katz LLC

(57) ABSTRACT

A counter includes a base and a countertop spaced from the base that has an edge that defines a border of the countertop. An edge or support collar is disposed between the base and the countertop, the edge collar including a light-transmissive band that extends along the border of the countertop. The light-transmissive band has an inner side and an outer side opposite the inner side that forms a stratified outer edge with the edge of the countertop. A light source is positioned adjacent the inner side of the edge collar and configured to emit light outward through the light-transmissive band.

24 Claims, 8 Drawing Sheets

OTHER PUBLICATIONS

Event bulletin, The Concrete Countertop Institute, "Special Event," www.cci.homestead.com, two sheets (Jun. 9, 2009).

Event bulletin, The Concrete Countertop Institute, "Fiber Optics in Concrete Countertops," www.concretecountertopinstitute.com, one sheet (Jun. 9, 2009).

Product advisory, DuPont Surfaces, "DuPont Corian Solid Surface 12mm Gauge Standardization," eight sheets (admitted prior art).

Promotional brochure, Brooks Custom, "Illuminated Glass Countertops," www.brookswood.com, one sheet (Jun. 9, 2009).

Product information, "DuPont Corian Illumination Series," www.2dupont.com, one sheet (Jul. 16, 2009).

Photo Gallery of Avonite Surfaces, www.avonitesurfaces.com, two sheets (Jul. 10, 2009).

Product information, North Star Colors, "North Star Solid Surface," www.nssurfaces.com, one sheet (Jul. 10, 2009).

* cited by examiner

COUNTER WITH BORDER LIGHTING

BACKGROUND OF THE DISCLOSURE

1. Field of the Disclosure

The disclosure relates generally to counters and, more particularly, to counters with border lighting or illuminated edges.

2. Brief Description of Related Technology

Countertops have been illuminated by a variety of lighting arrangements. In many cases, the countertop is illuminated by light directed from fixtures mounted on a ceiling or wall above the countertop. For example, light fixtures are commonly positioned under wall-mounted cabinetry disposed directly above the countertop being illuminated. By directing light toward the countertop from above, these arrangements improve visibility in the work space defined by the countertop. A light source above the countertop can also enhance decorative features of the countertop surface. Unfortunately, the positioning of the light sources also determines that cabinet, wall, and other surfaces are shadowed by the countertop.

Arrangements in which the light emanates outward from the countertop have also been fabricated, but at the expense of complexity, cost, and an undesirable appearance during periods of non-illumination. These complications have arisen from the material(s) used to fabricate the countertop, as well as from the integration of light sources and the solid surface of the countertop.

Translucent materials have been used to fabricate light-emitting counter arrangements. Unfortunately, the translucent materials are often either expensive or less durable than materials typically used for countertop surfaces. Onyx natural stone and artificial solid surfaces fall into the former category, while glass and plastic sheeting fall into the latter category.

Translucent countertops have also have also been considered aesthetically undesirable when the light sources are not illuminated. Sub-surface objects are often visible, including the light sources themselves. The interior of a cabinet can be seen in cases in which the translucent material forms the entire depth of the counter. Even when illuminated, the light sources have been found to reveal or highlight seams, adhesive layers, and defects in or around the countertop.

Another light-emitting counter arrangement has utilized luminescent materials. U.S. Pat. No. 7,141,287 describes strips of luminescent solid surface material glued to edges of a laminate countertop. The positioning of the strips covers the countertop edges, thereby changing the appearance of the counter considerably.

Some counters have incorporated light elements within the countertop material. Cement countertops have been poured with optical fibers running through the thickness of the cement layer and terminating at the countertop surface. Other cement counters have been poured with inlaid stained glass. U.S. Patent Application Publication No. 2006/0198128 describes LEDs embedded in countertop materials such as Corian® solid surfaces. Unfortunately, the fabrication of such counters can be considerably difficult, and the appearance of the countertop may be undesirable during periods of non-illumination.

SUMMARY OF THE DISCLOSURE

In accordance with one aspect of the disclosure, a counter includes a base, a countertop spaced from the base and having an edge that defines a border of the countertop, an edge collar disposed between the base and the countertop, the edge collar including a light-transmissive band that extends along the border of the countertop, the light-transmissive band having an inner side and an outer side opposite the inner side that forms a stratified outer edge with the edge of the countertop, and a light source positioned adjacent the inner side of the edge collar and configured to emit light outward through the light-transmissive band.

The outer side of the light-transmissive band and the edge of the countertop may be arranged such that the stratified outer edge has a flush surface. The base may include a support band that extends along the border of the countertop. The support band may then have an outer side that forms a bottom layer of the stratified outer edge. The base may include a cabinet wall on which the intermediate collar rests.

In some cases, the light source includes a plurality of light elements spaced apart along the inner side of the light-transmissive band. The light source may then further include a strip on which the plurality of light elements are carried. The counter may then further include an elongated seal that secures the plurality of light elements against the inner side of the light-transmissive band.

The base may extend inward beyond the inner side of the light-transmissive band to form a channel between the countertop and the base in which the light source is disposed. The light-transmissive band may include an elongated glass block disposed between the base and the countertop.

The light-transmissive band may be sandwiched between the countertop and the base. Alternatively or additionally, the light-transmissive band supports the countertop.

In some cases, the base includes an under-mount sink flange.

In accordance with another aspect of the disclosure, a counter includes a lower layer, an upper layer spaced from and overlapping the lower layer, the upper layer having an edge that defines a border of the upper layer, and a support collar disposed between the lower and upper layers, the support collar including a light-transmissive band that extends along the border of the upper layer to space and support the upper layer above the lower layer, the light-transmissive band having an inner side and an outer side opposite the inner side that forms a stratified outer edge with the edge of the upper layer. A light source is positioned adjacent the inner side of the support collar and configured to emit light outward through the light-transmissive band.

In some cases, the counter further includes a countertop that forms the lower layer and a drop-in sink having a rim that forms the upper layer.

Alternatively, the counter further includes a countertop that forms the upper layer. The outer side of the light-transmissive band and the edge of the upper layer may then be arranged such that the stratified outer edge has a flush surface. The base may then include a support band that extends along the border of the upper layer, the support band having an outer side that forms a bottom layer of the stratified outer edge.

The base may include a cabinet wall on which the support collar rests.

The light source may include a plurality of light elements spaced apart along the inner side of the light-transmissive band. The light source may then further include a strip on which the plurality of light elements are carried. The counter may then further include an elongated seal that secures the plurality of light elements against the inner side of the light-transmissive band.

The light-transmissive band may include an elongated glass block disposed between the lower and upper layers. The light-transmissive band may alternatively or additionally be sandwiched between the lower and upper layers.

BRIEF DESCRIPTION OF THE DRAWING FIGURES

For a more complete understanding of the disclosure, reference should be made to the following detailed description and accompanying drawing figures, in which like reference numerals identify like elements in the figures, and in which.

Figure 1:
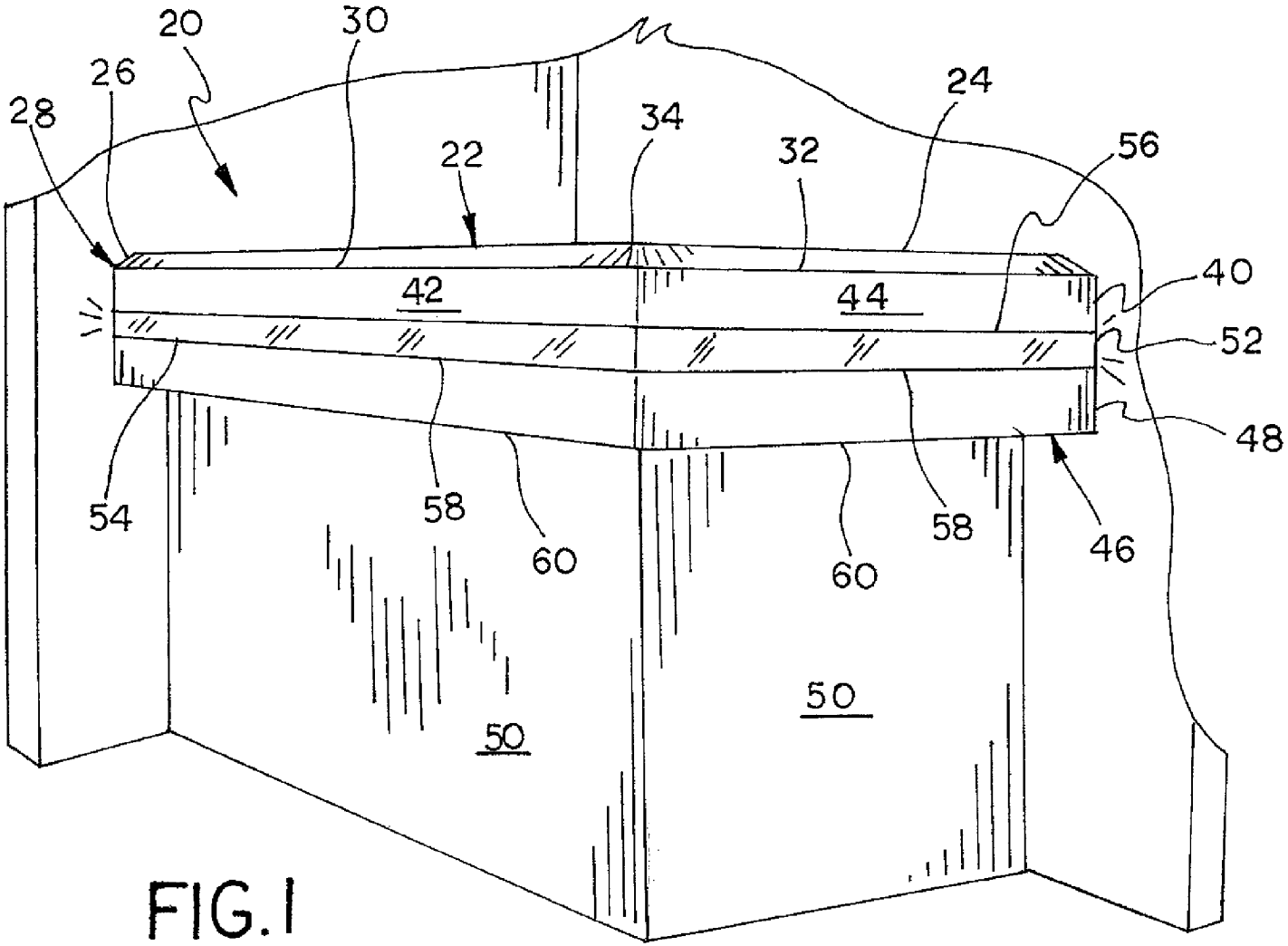
FIG. 1 is a perspective front view of an exemplary counter with a light-emitting edge or border constructed in accordance with one or more aspects of the disclosure.

While the disclosed structures are susceptible of embodiments in various forms, there are illustrated in the drawing (and will hereafter be described) specific embodiments of the invention, with the understanding that the disclosure is intended to be illustrative, and is not intended to limit the invention to the specific embodiments described and illustrated herein.

DETAILED DESCRIPTION OF THE DISCLOSURE

The disclosure generally relates to counter arrangements configured to emit or project light through borders or edges of the counter without requiring complex and costly fabrication. The disclosed counter arrangements provide significant illumination of the surrounding area with a minimal amount of translucent material, and without modifying the appearance of the countertop surface of the counter. The disclosed counter arrangements also avoid substantial modifications to the appearance of the borders or edges themselves. Moreover, the positioning of a light source along the border or edge of the counter allows the light source(s) to be conveniently accessible for repair, replacement or other adjustments. The disclosed positioning of the light elements also helps to conceal the light source(s) during periods of non-use.

The disclosed counter arrangements are generally configured to support a considerable amount of illumination. As described below, a substantial fraction of the light is dispersed upward and downward from the level of the countertop. The dispersion provides both useful illumination of the surrounding objects in the room and visually pleasing light effects along the walls and other objects near the counter. The dispersion is accomplished despite the internal positioning of the light source(s) along the edge or border of the counter.

The disclosed counter arrangements provide the illumination through a stratified edge structure formed from a collar or band that extends along a border of the countertop. The collar or band is translucent to allow light emitted from a light source behind the collar or band to be projected outward. In some cases, the edge of the countertop and an outer side of the collar form a flush, vertical edge surface, effectively hiding or obscuring the collar or band when the light source is not illuminated. The stratified edge structure may include a support band of a base that supports the countertop.

The light provided by the disclosed counters may be used in a variety of ways. For instance, the light may help an individual avoid hitting the countertop in the dark when a user may not want to turn on a room light. In this way, the disclosed counters may be useful as a nightlight. The projection of light outward from the counter may be especially useful in those cases where the counter is darkly colored or otherwise does not reflect significant amounts of light. The light projection becomes a clear or distinct indication of the location of the edge of the countertop. The disclosed counters may also provide decorative or entertainment lighting for a variety of applications and environments.

Although described in connection with counter arrangements having a countertop for a kitchen or bathroom, the disclosed counters are not limited to these applications or installation contexts. Instead, the examples described below may be applied to a variety of different types of fixtures or articles of furniture. Thus, the terms "counter" and "countertop" are used herein in a broad sense to include a variety of different types of items or articles having a work or decorative top surface. Thus, the terms are not to be construed as limited to only kitchen and bathroom counters, but construed broadly to include, for instance, other fixed or movable items in a residential or commercial environment having a generally platform- or countertop-like top surface. The structure of any objects supporting the platform or countertop-like surface, such as cabinets, shelving, and the like, may thus vary considerably.

Figure 2:
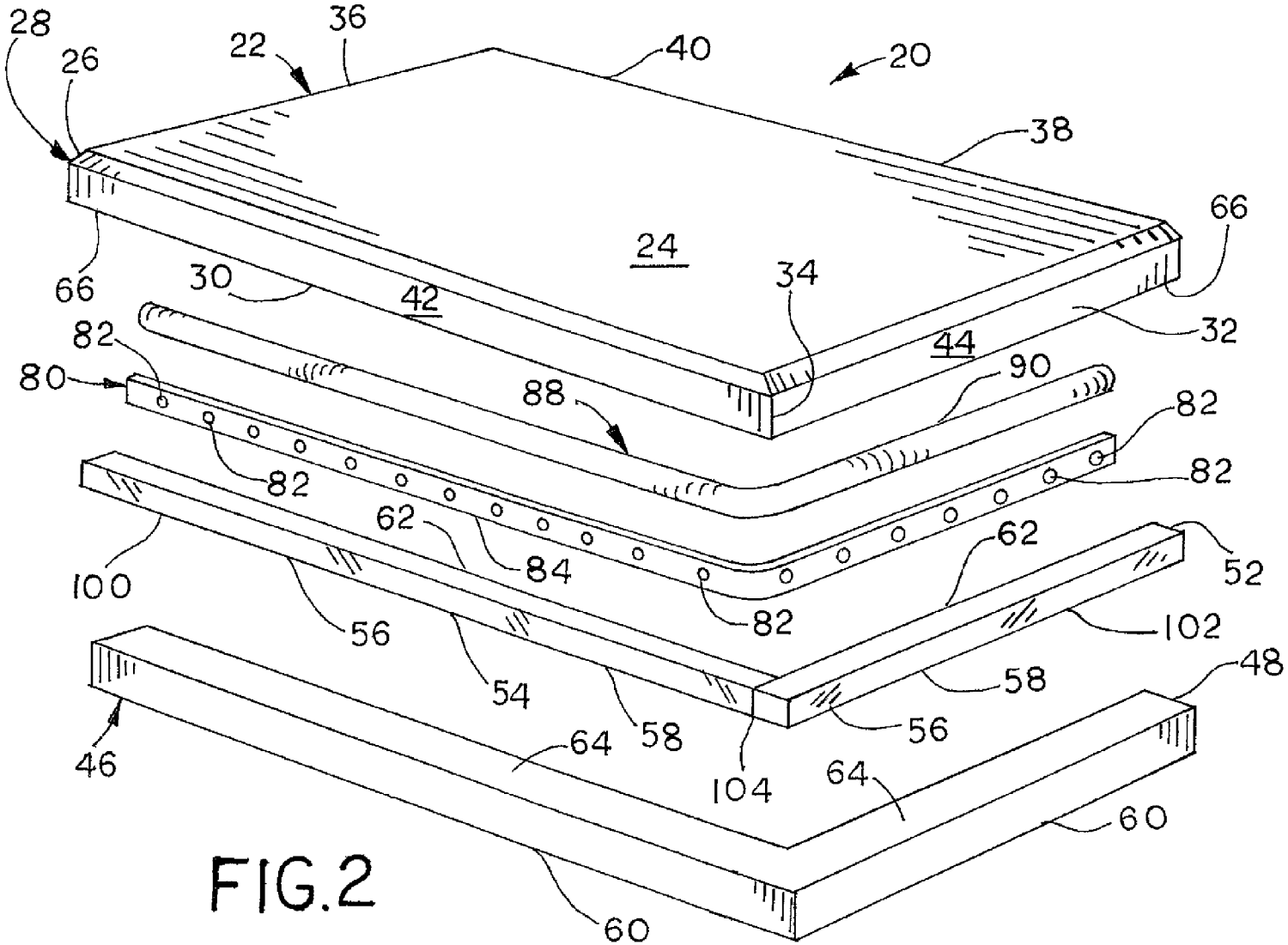
FIG. 2 is an exploded view of the counter of FIG. 1.

Turning now to the drawings, FIGS. 1 and 2 show one example of a counter 20 constructed in accordance with the disclosure. The counter 20 includes a countertop 22 with a generally flat or planar top surface 24. The top surface 24 of the countertop 22 may be used as a work surface, desktop, tabletop, countertop, or any other type of functional and/or decorative surface. The countertop 22 is generally configured as a substantially horizontal platform having a rectangular shape when viewed from above. However, the orientation, shape, and other characteristics of the top surface 24 may vary considerably from the example shown. In some cases, the surface 24 (or sections thereof) may be oriented vertically or at some other angle with respect to horizontal, and may be non-flat or non-planar to varying degrees as desired. In this example, the top surface 24 of the countertop 22 has a beveled area 26 at or near a border 28 of the countertop 22. Alternatively or additionally, a variety of other contours, inclines, grooves, and other surface shapes or treatments may be incorporated into the top surface 24, the border 28, or other areas or surfaces of the countertop 22.

The border 28 of the countertop 22 has two exposed sides 30, 32 that meet at a front corner 34. In this example, the sides 30, 32 terminate at respective walls against which two concealed sides 36, 38 are positioned as shown. Each side 30, 32, 36, 38 is straight, rendering the border 28 rectilinear in this example. More generally, the border 28 may have any number of curved or straight sides, any number of corners, and any number of exposed or concealed sides. Thus, the counter 20 need not be mounted, secured or positioned adjacent to a wall, and instead be a freestanding article or fixture. As described below in connection with sink examples, the border 28 need not reflect or be associated with an external boundary as shown, but rather may alternatively be associated with an internal boundary of the countertop 22.

The countertop 22 is generally formed or fabricated to ensure that the top surface 24 provides a rigid, solid or durable upper or decking layer of the counter 20. A variety of materials may be used either alone or in combination to form the countertop 22, including any conventional natural or artificial countertop material (e.g., granite, Corian®, laminates, etc.). The material is then cut, molded, or otherwise shaped in the manner appropriate for the material. In this example, the countertop 22 includes a single slab 40 that serves as the decking layer of the counter 20. The slab 40 has edges 42, 44 along the exposed sides 30, 32 that define the border 28. The edge 42 extends along the length of the side 30, while the edge 44 extends along the length of the side 32. The slab 40 may have a uniform thickness that establishes the height of each edge 42, 44. In some examples, the thickness of the slab 40 may range from about 0.75 mm (e.g., a laminate layer) to about 63.5 mm (e.g., two layers of 1.25 inch or 3 cm thick granite glued to one another). In some cases, the slab 40 has a thickness that varies between, for instance, a thinner region (s) away from boundaries and a thicker region(s) near boundaries such as perimeter edges.

The countertop 22 is supported by a base 46. In this example, the base 46 includes a support band or rim 48 and a number of support walls 50 (FIG. 1) upon which the support band 48 rests. Each wall 50 generally spaces the support band 48 and, more generally, the countertop 22 from a floor or ground surface as shown. The walls 50 may have an exposed or external face, such as those extending along the sides 30, 32 as shown in FIG. 1. The walls 50 may also be concealed or internal, such as those extending along the sides 36, 38. The shape, structure and other characteristics of the walls 50 or other components of the base 46 may vary considerably from the example shown.

The support band 48 of this example forms an external rim that extends along all or a portion of the border 28 of the countertop 22. As shown in FIG. 2, the support band 48 may only extend along the exposed sides 30, 32. The partial extent of the band 48 may be directed to reducing material costs, insofar as the support band 48 may be formed from the same material as the countertop 22. As such, the support band 48 may be formed from one or more elongated blocks or bars of solid surface countertop material. Use of the same material generally improves the decorative or aesthetic appearance of the countertop 22, creating the impression of a thicker countertop slab. The thickness of the support band 48 may also be the same as, or similar to, the thickness of the slab 40. The support band 48 may accordingly have a thickness that falls within the range identified above for the slab 40.

One advantage of the disclosed counters is that this aesthetic improvement is accomplished despite an intermediate layer 52 that separates the support band 48 and the countertop slab 40, forming a stratified edge or border of the counter 20. As described below, all or part of the intermediate layer 52 is typically not formed of the same countertop material as the countertop slab 40 and the support band 48. Nonetheless, the presence of the intermediate layer 52 between the support band 48 and the countertop slab 40 may be negligible based on one or more characteristics of the intermediate layer 52. For instance, the intermediate layer 52 may be relatively thin compared to the support band 48 and the countertop slab 40. In some cases, the intermediate layer 52 may have a thickness that ranges from about 0.125 inches to about 1.25 inches. Below the lower end of the range, it starts to become impractical to project sufficient light from the intermediate layer 52. Above the higher end of the range, the thickness of the intermediate layer 52 begins to change the look and nature of the counter arrangement, with the intermediate layer 52 becoming considerably noticeable. Even when the intermediate layer 52 is roughly as thick as the other layers, the intermediate layer 52 may not be very noticeable due to the materials of the layers. As described below, the intermediate layer 52 may be relatively clear, while the support band 48 and the countertop slab 40 may be relatively opaque. Cost considerations may also be a factor in selecting the thickness of the intermediate layer 52.

The intermediate layer 52 may be configured as an edge or support collar 54 disposed between the countertop 22 and the base 46. In this example, the collar 54 is sandwiched between the layers established by the countertop 22 and the base 46, namely the slab 40 and the support band 48. As a result, the collar 54 supports the weight of the countertop slab 40. The collar 54 is elongated and shaped to extend along the length of the exposed sides 30, 32. In this way, the collar 54 extends along the border 28 of the countertop 22. As shown in FIG. 2, the collar 54 does not extend along the concealed sides 36, 38 in this example. The intermediate layer 52 and the collar 54 thereof may, but need not, be shaped as one or more elongated blocks or bars as shown in FIG. 2.

In accordance with one aspect of the disclosure, the intermediate layer 52 is generally directed to creating a countertop with border lighting. To this end, the collar 54 generally includes one or more light-transmissive bands 56 that extend along the border 28 of the countertop 22. Each band 56 is formed of a material that generally allows light to pass through the intermediate layer 52 and project outward from the stratified edge. To that end, the band 56 may be transparent, translucent, or otherwise non-opaque. In some cases, the band 56 may be made of glass or other clear or semi-clear materials. Alternatively or additionally, the band 56 may include or be made of one or more materials that are luminescent, phosphorescent, fluorescent, electroluminescent, or otherwise light-emitting.

Along the border 28, an outer edge 58 of the light-transmissive band 56 forms a stratified outer edge with the edges 42, 44 of the countertop 22. In this example, the stratified outer edge also includes an outer edge 60 of the support band 48 of the base 46. The layers formed by the edges 42, 44, 58, 60 are thus stacked to present a composite or banded edge or surface to an individual observing the counter 20 at, for instance, eye level. However, as described below, the individual edges or layers of the stack or stratified edge are not generally apparent when light is not emitted from the band 56, especially when the observer is not observing the counter 20 closely.

The composite or stratified outer edge is oriented vertically in this example. To that end, each of the edges 42, 44, 58, 60 are also oriented vertically. The edges 42, 44, 58, 60 are also aligned in this example to form a flush outer surface. As a result, the composite or stratified outer edge may appear continuous or uniform to an observer. The exposed surfaces of the edges 42, 44, 58, 60 may also be polished to further render their appearance difficult to distinguish when light is not projected through the band 56. For example, if the slab 40 and band 48 are made of granite and the collar 54 is glass, the polishing of the corresponding edges may increase the reflectivity of the outer surfaces of the edges 42, 44, 58, 60, thereby rendering the layers difficult to discern.

One or more sources of light may be activated to direct light through the collar 54. As described below, the source(s) of light are generally positioned adjacent an inner side 62 of the band 56 and, thus, behind the collar 54. With the countertop and base materials generally opaque or non-transmissive, the light is channeled primarily laterally outward, passing through the outer edge 58. In this example, the light is primarily projected horizontally away from the vertical face of the stratified outer edge.

As schematically shown in FIG. 1, the light is also dispersed upward and downward from the level of the collar 54. The dispersion may be provided by diffusion as the light is scattered within the band 56. Alternatively or additionally, the dispersion may be enhanced by reflection of the light off of an upper or top surface 64 (FIG. 2) of the support band 48 or a lower or bottom surface 66 (FIG. 2) of the slab 40.

The light emitted from the counter 20 need not be limited to lateral projection. The countertop 22 and/or the base 46 may also be light-transmissive to any desired extent to allow light to project vertically upward or downward. For example, the slab 40 (or portions thereof) may be translucent or transparent to allow light to pass through the countertop 22 in addition to the light passing through the band 56.

Although the edges 58 of the intermediate layer 52 are flush with the edges 42, 44, and 60, the relative positioning of the faces of each edge may vary from the positions shown in the example of FIG. 1. For instance, the exposed edge 58 may be retracted or inset from the edges 42, 44, and 60. The exposed edge 58 may also protrude outward from the edges 42, 44, and 60, which need not be vertically aligned as shown.

The shape and configuration of the edges 58 of the intermediate layer 52 may also vary substantially from the example shown. Contours, inclines, grooves, and other surface shapes or treatments may be incorporated into the edge 58 of the intermediate layer 52. The band 56 may also be configured to have any number of optical characteristics to produce a desired lighting effect(s). For instance, the edge 58 may be treated or altered such that light emitted from through the edge 58 has a specific or desired pattern. The pattern may be projected onto surrounding room walls or other nearby objects. The edge 58 may also be contoured to act as a lens and disperse the light and/or direct the intensity in a particular direction.

Figure 3:
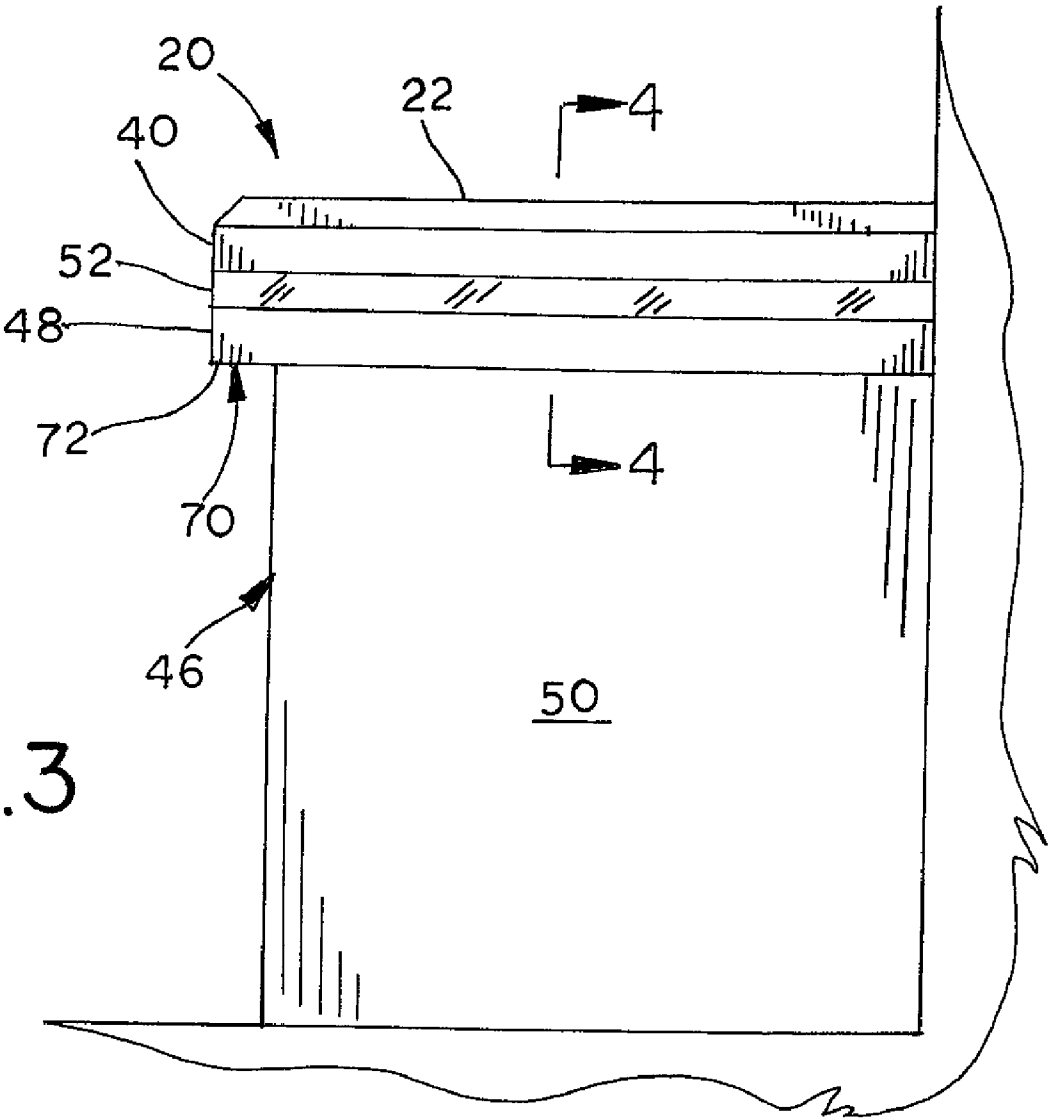
FIG. 3 is an elevational side view of the counter of FIG. 1.

As shown in FIG. 3, the countertop 22, the intermediate layer 52, and the support band 48 extend laterally outward beyond the walls 50 to define an overhang 70. When viewed from below, the overhang 70 is defined by a bottom surface 72 of the support band 48 that rests on and extends beyond the walls 50 and any other components of the base 46. toward the exposed edge face 62. In alternative cases, one or more light sources (not shown) may be positioned such that light is also projected through the overhang 70 (passing through the bottom surface 72), along the overhang 70, or otherwise downward, outward, or inward from the overhang 70.

Although the counter 20 is shown positioned against adjoining walls, the disclosed counters are not limited to any particular positioning or shape. In fact, the disclosed counters may be stand alone articles or island fixtures with external edge surfaces along an entire perimeter, which may be curved or contoured in any desired shape. For these and other reasons, the disclosed counters may be utilized in a variety of contexts and arrangements. For instance, the counters may be implemented as backsplashes, side splashes, fireplace hearths and mantels, surrounds and wall coverings, wet/dry butler tops, buffet bars, kitchen counters, tabletops, and vanity tops, to name but a few examples.

The above-described layers and components of the counter 20 may be secured to one another in a variety of ways. In some cases, one or more adhesives may be used to secure the countertop slab 40 to the intermediate layer 52, and to secure the intermediate layer 52 to the base support band 48. Exemplary adhesives well-suited for securing the layers to one another include epoxy, contact cement, solid surface adhesive, and cyanoacrylate. The adhesive may be applied in a manner that minimizes any detrimental effects on the transmission of light from the band 54. In some cases, an adhesive layer (not shown) may be positioned away from the outer edge 58 of the band, and/or may be only present at intervals along the length of the border 26. Other fasteners such as screws and the like may alternatively or additionally be used to secure the layers in place. In other cases, the layers and components of the counter 20 may rest upon one another without any adhesives or other fasteners, relying instead on the weight of the countertop slab 40 to establish sufficient friction to maintain the positioning of the layers.

The nature of the interfaces between the intermediate layer 52, the countertop 22, and the base 46 may affect the way in which light is transmitted through the band 58 and ultimately projected out from the stratified outer edge of the counter 20. For instance, the surfaces 64 and 66 of the base support band 48 and the countertop slab 40, respectively, may be altered or treated for reflective purposes. In one example, the surfaces 64, 66 are polished to promote reflection. Similarly, the top and bottom surfaces of the band 58 may also be polished or otherwise altered or treated to promote reflection. In some cases, one or more of the surfaces may still provide or promote reflection despite being unpolished or unaltered.

With reference now to FIG. 2, the counter 20 in this example includes a light source 80 that extends along the inner side 62 of the band 54. The light source 80 includes a number of lighting elements 82 distributed along a ribbon or other strip 84. In this case, the strip 84 generally extends the length of the perimeter sides 42, 44. However, the lighting elements 82 need not be distributed or evenly spaced apart along the strip 84 as shown, but may be arranged or positioned in a variety of ways to produce a desired lighting effect(s). In some examples, each lighting element 82 is a light-emitting diode (LED) lamp mounted on the strip 84. The lighting elements 82 and the strip 84 may be manufactured as an integrated component, such as the LED ribbon commercially available from Honglitronic (Guangzhou, China, Guangzhou Hongli Opto-Electronic Co. Ltd., en.honglitronic.com).

A variety of other lamps, elements, or sources may be used for the light source 80. In alternative cases, the light source 90 may be rope lighting, fiber optic, glow wire, lasers, or any other source of illumination. Instead of running along the border of the countertop 22, the light source 90 may alternatively or additionally be a light bulb or other lamp positioned within a cabinet interior defined by the counter 20.

The strip 84 and, more generally, the light source 80 may be secured in position in a variety of ways. In those cases where the light source 80 is adjacent the band 54, the strip 84 may be adhesively or otherwise secured to the inner side 62 of the band 54. The strip 84 may alternatively or additionally be attached to one or both of the surfaces 64 and 66, such as when If the light source 80 is spaced from the inner side 62. The strip 84 may also be supported within the interior of the base 46 independently of the components of the stratified outer edge using, for instance, one or more clamps, frames or other structures (not shown) of the light source 80 positioned under the countertop 22.

In this example, a seal 88 disposed behind the strip 84 may also help to secure the light source 80 in position. In this example, the seal 88 includes a flexible tube 90 extends the length of the strip 84 and, thus, may also protect the lighting elements 82 from moisture and other damage. In some cases, the tube 90 may be made of rubber, rubber-like or rubberized materials. Further details regarding the seal 88 are set forth below in connection with the examples shown in FIGS. 4 and 6.

With reference again to FIG. 2, the light-transmissive band 56 of this example includes two bars 100, 102, which extend along the perimeter sides 42, 44, respectively. The bars 100, 102 meet at a seam 104 offset from the corner 34 of the countertop 22. In this example, the seam 104 corresponds with an end of the bar 100, as the bar 100 abuts an inner side of the bar 102.

The light-transmissive band 56 may vary considerably from the example shown. For instance, the light-transmissive band 56 may include one continuous bar or block that runs the length of the border 28. Alternatively, the light-transmissive band 56 may include any number of bars along the border 28. The shape and configuration of the light-transmissive band 56 may also vary from the rectangular cross-sectional bars 100, 102 shown. For instance, the bars 100, 102 or, more generally, the light-transmissive band 56 may be shaped as a prism or other polyhedron with any number of sides through which the light passes. These shapes or configurations may facilitate the dispersion of the light emitted by the light source(s). However, the band 56 need not have flat sides. For instance, the band 56 may be cylindrical or otherwise rounded to present a curved outer surface through which the light passes. In this way, the band 56 may act as a lens (convex or concave) for distributing the light in a desired manner. More generally, the band 56 may have any shape or configuration that allows the intermediate layer 52 to provide the light-emitting feature. The other surfaces or sides of the band 56 may also vary with inclines, contours, grooves, and other shapes to, for instance, create desired lighting effects, mount the light source(s), or facilitate the assembly of the counter 20.

The manner in which the bands 56 of the example shown in FIG. 2 are arranged may also vary considerably from the example shown. For instance, the ends of each band 56 may be angled at corresponding 45° angles such that the seam 104 is disposed at the corner 34. Moreover, the ends of each band 56 may be contoured to present, for instance, a rounded shape at the corner 34. In fact, any surface interface that permits joining or other juxtaposition of the bands 56 may be utilized. The interface may also be configured to achieve a desired lighting effect. Notwithstanding the foregoing, the bands 56 may alternatively be un-joined or separated to a desired extent.

FIG. 3 depicts one of the few, if any, views of the counter 20 in which the source(s) of illumination may be noticeable or visible to an observer. One reason involves the positioning of the light source(s) behind the intermediate layer 52, which, in turn, is disposed between the countertop slab 40 and the base support band 48. Only a relatively flat angle of observation allows the observer to see through the intermediate layer 52. The observer may also not notice the intermediate layer 52 itself unless looking from the side at the level of FIG. 3. Moreover, a decrease in the height of the intermediate layer 52 lowers the angle and the likelihood of noticing the intermediate layer 52 and the light source(s) behind it.

Figure 4:
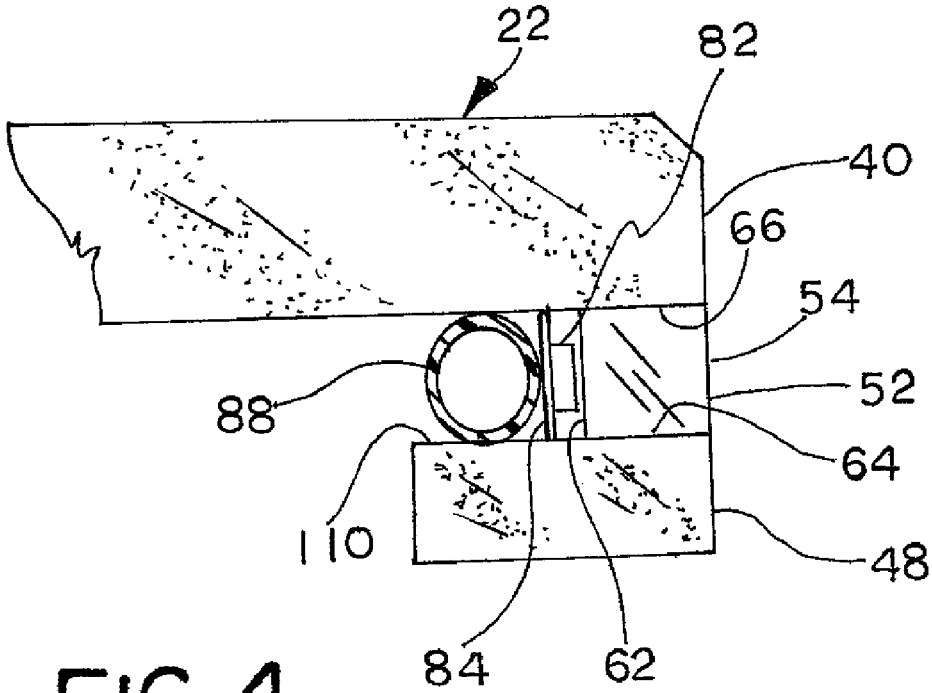
FIG. 4 is a cross-sectional view of the counter of FIG. 1 taken along the line 4-4 in FIG. 3.

FIG. 4 depicts the stratified outer edge and lighting arrangement in greater detail. In this example, the base support band 48 extends inward farther than the collar 54 of the intermediate layer 52, defining a shelf 110 on the upper surface 64 of the support band 48. The shelf 110 provides a channel in which the strip 84 and the seal 88 may be positioned. Together, the shelf 110, the slab 40, and the seal 88 close off access to the strip 84. The seal 88 may also be used to position the strip 84 against the inner side 62 of the collar 54. To these ends, the seal 88 may have a cross-sectional diameter thickness that matches the spacing between the countertop slab 40 and the base support band 48. The seal 98 protects and closes off access to the strip 94.

In some cases, the upper surface 64 of the base support band 48 and the lower surface 66 of the slab 40 may be unpolished or untreated to promote adhesion. The surfaces 64. 66 thus provide a mechanism for robust attachment of the components of the counter 20. Although unpolished, the surfaces 66, 68 may still facilitate the projection of a significant amount of light via reflection.

The positioning of the light source(s) may vary substantially from the example shown. For instance, the depth of the collar 54 of the intermediate layer 52 may be increased to thereby increase the inset depth of the strip 84 and further decrease the likelihood of an observer detecting the lighting elements 82 when not activated. The lighting elements 82 also need not be substantially centered between the surfaces 64 and 66. Still further, the lighting elements 82 need not be oriented to project light laterally outward as shown. For instance, the lighting elements 82 may be positioned vertically off center or oriented at an angle to produce desired light effects.

Figure 5:
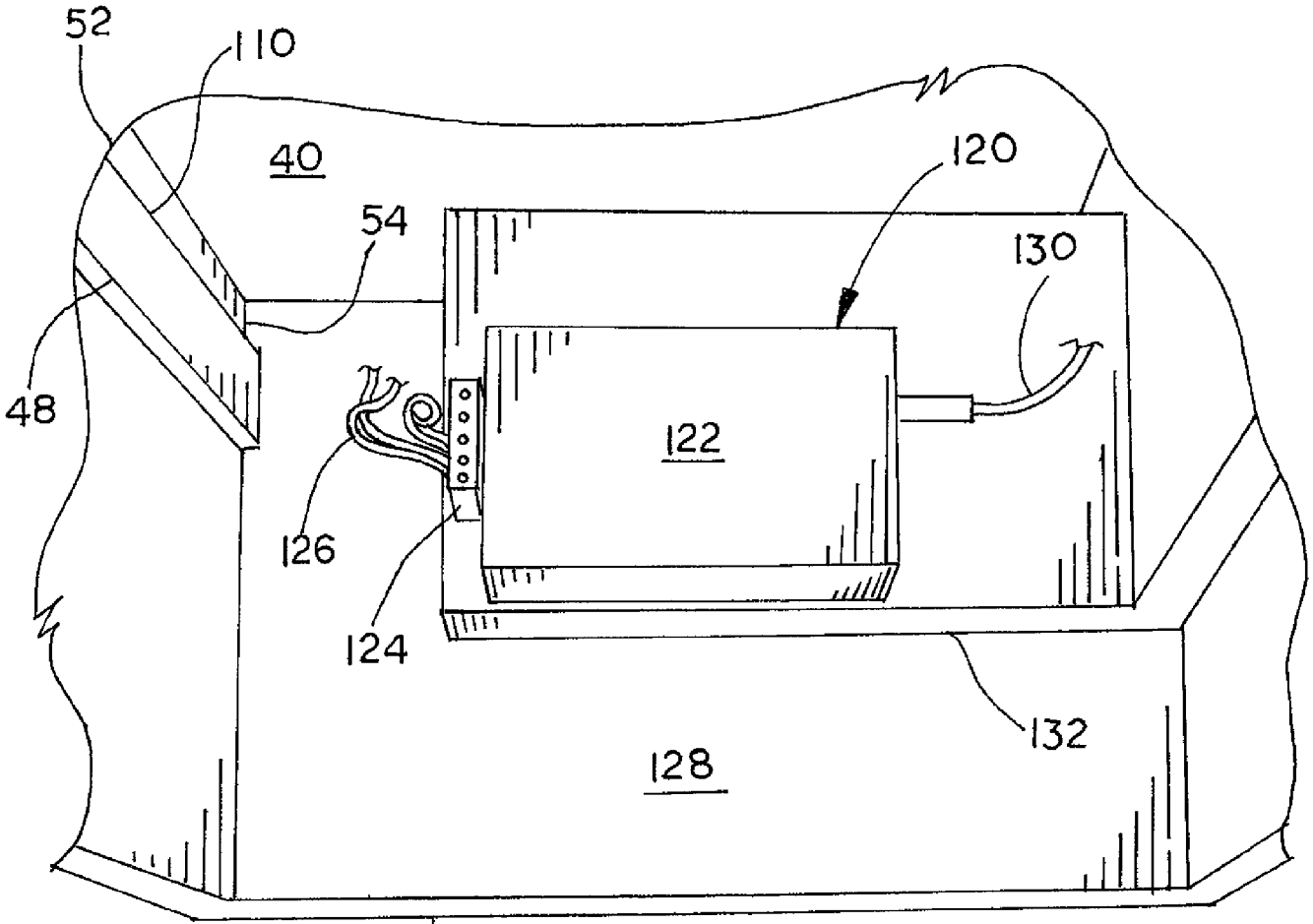
FIG. 5 is a partial, perspective bottom view of the counter of FIG. 1 to depict an interior of an exemplary cabinet base in accordance with another aspect of the disclosure.

Turning now to FIG. 5, the interior region defined by the counter 20 is shown to depict a controller 120 for the light source(s) 90 (FIG. 2). The controller 120 includes a housing 122 that encloses one or more components of the controller 120 not shown in the drawing, including, for example, one or more processors, one or more memories (e.g., EEPROM), an RF receiver, a power supply (e.g., an AC-to-DC converter), and an amplifier. The controller 120 also includes an output interface or wire harness 214 to which a set of cables 126 are attached. The cable set 126 is connected to the LED strip 84 (FIG. 2) to support the delivery of power and/or control signals to the LED elements 82 (FIG. 2). The controller 120 may be one of several commercially available RGB controllers. For example, the RGB controller available from Honglitronic (Model No. HL-CWH3H10-B) may be used. In that case, the cable set 126 leading from the controller 120 is a four-line set having one DC power line and three return/control lines for each color (red, green, blue).

The controller box 120 may reside in one of a number of operational modes, each mode generally supporting a different type of illumination. For example, the above-identified RGB controller from Honglitronic has 11 distinct operational modes. Each mode may be distinguished from the other by the color of the light produced, the brightness of the light, and any other characteristics of the illumination, including, for instance, whether the light is flashing or static. One or more operating modes may also be configured to provide illumination that varies over time, including, for instance, toggling or other transitions between colors. The controller box 120 may also be operated by a remote (not shown) for convenient selection of one of the operating modes and activation/deactivation of the light source 90.

The controller box 120 may be positioned or mounted in any desired manner. In some cases, an interior location provides convenient access to the light source 90, but may require a power cord 130 to be fed into the interior space defined by the counter 20. In this example, the controller box 120 is mounted to an inner side 128 of one of the upstanding cabinet walls 50. A mounting plate 132 is disposed between the side 128 and the controller housing 122 to allow the controller 120 to be securely attached and positioned within the interior.

The LED strip 84 and the seal 88 are not shown in FIG. 5 to better illustrate one example of the stratified edge of the counter 20. The countertop slab 40 rests upon the edge collar 54 of the intermediate layer 52, which, in turn, rests upon the base support band 48. The shelf 110 defined by the base support band 48 is also shown.

The disclosed counters are not limited to the control arrangement described above. A variety of control schemes may be used to accommodate different light sources. For example, some arrangements need not have a dedicated controller. Instead, the light source 90 may be controlled by any conventional light switch positioned on a wall outside the interior space defined by the counter 20. These and other arrangements may involve one or more controller or control devices located remotely from the counter 20.

Figure 6:
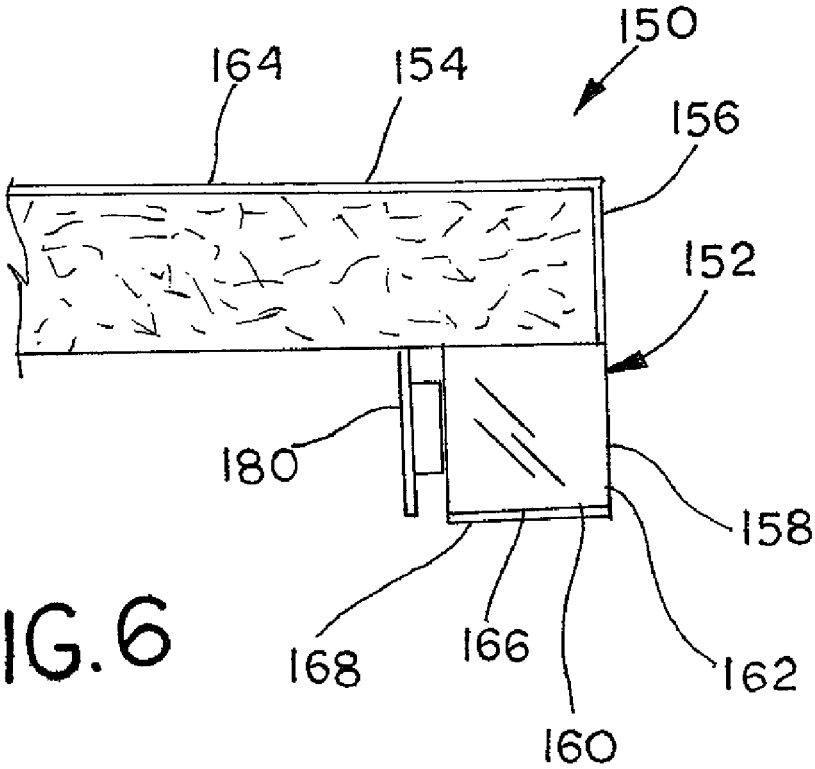
FIG. 6 is a cross-sectional view of an alternative countertop arrangement with border lighting constructed in accordance with one or more aspects of the disclosure.

FIG. 6 is a cross-sectional view of another example of another exemplary countertop 150 with a stratified outer edge 152 in accordance with the disclosure. In this example, the countertop 150 has a generally flat or planar top surface 154 elevated above a floor. Like the examples described above, the countertop 150 has a set of stacked or built-up layers that form the stratified outer edge 152. In this example, the stacked layers include a top or decking layer 156 and an edge or support collar 158, which, in turn, rests on top of a cabinet or other base (not shown). Alternatively or additionally, the top layer 156 may rest on the cabinet base. In a further alternative, the countertop 150 may be independently supported by another base layer extending from the floor or by a wall.

The collar 158 includes a light-transmissive band 160 similar to the example described above. Thus, the band 160 may be translucent or transparent to allow light to pass through an outer side or face 162 of the band 160.

A number of surfaces in the example of FIG. 6 have laminate covers. For instance, a laminate cap 164 covers both the top and side surfaces of the decking layer 156 to make the top surface 154 of the countertop 150 more robust. The collar 158 may also be partially covered to match the appearance of the top surface 154. In this example, a bottom surface 166 of the collar 158 has a laminate cover 168 as shown. The laminate caps or covers 164, 168 may be conventionally adhered to the respective surfaces. In this example, the cap 168 may be non-translucent in order to block light from passing through the bottom surface 166 of the collar 158. Alternatively or additionally, the cap 168 may provide a reflective surface for facilitating the projection of light as described above. To that end, a light source 180 may be positioned along an inner side of the collar 158 as described above.

In this example, each of the stacked layers is formed of a uniform and solid material. The top layer 156 may be formed of particle board and the skirt layer 158 may be plexi-glass. Other characteristics of these layers may vary as described above with the example of FIGS. 1-3.

Figure 7:
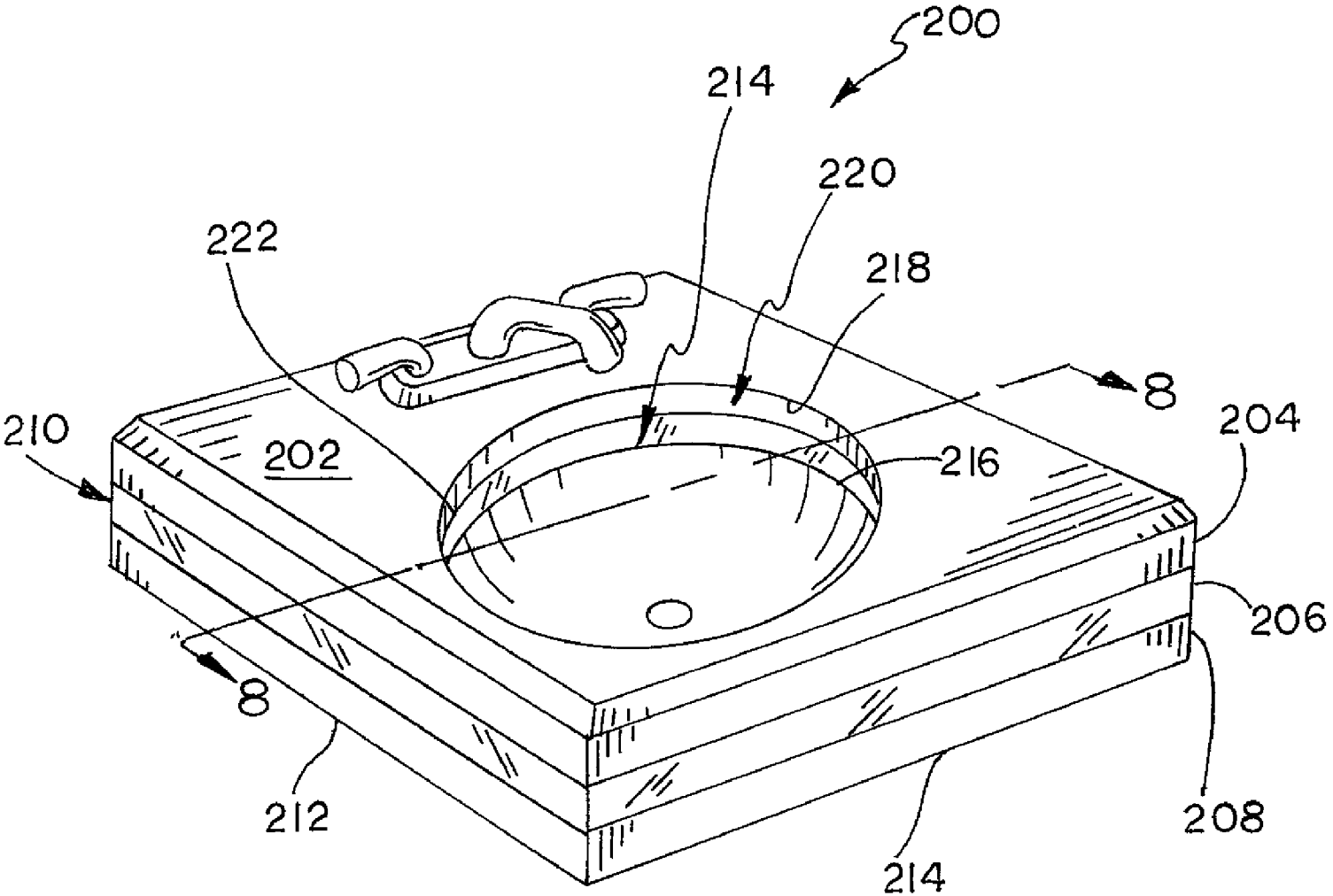
FIG. 7 is a perspective view of an exemplary sink counter with border lighting constructed in accordance with one or more aspects of the disclosure.

FIG. 7 shows another example of a counter 200 with multiple light-emitting edge surfaces for an under-mount sink arrangement. As with the examples described above, the counter 200 has a countertop surface 202 forming a top layer 204, an intermediate collar 206, and a base layer 208, which together form a stratified or composite edge 210 having perimeter sides 212, 214. Each side 212, 214 may be configured in a manner similar to the examples described above. As a result, the intermediate layer 206 may bear the weight of the top layer 204 while providing lighting around the perimeter or border of the counter 200.

In this example, the counter 200 includes an under-mount sink bowl 214 with an annular perimeter 216. The sink bowl 214 may be opaque, non-opaque or translucent as desired. The sink 214 is positioned in an opening 218 formed through the top surface 202 that matches the perimeter 216 of the sink 214 in this example. The opening 218 has a stratified or composite edge 220 constructed in accordance with the disclosure. Like the edge 210 around the border of the counter 200, the composite edge 220 is formed by surfaces or exposed faces of stacked layers. The stacked layers include the top layer 204, an interior intermediate collar 222, and the perimeter 216 of the sink 214. The interior intermediate collar 222 is sandwiched or otherwise disposed between the top layer 204 and the perimeter 216 of the sink 214. As with the examples described above, the exposed surfaces of the stacked layers may be flush.

The interior intermediate collar 222 of the composite edge 220 has a number of features in common with the examples described above. The intermediate collar 222 may include one or more light-transmissive components configured for projection outward from the composite edge 220. Light projected through the intermediate collar 222 is directed into the sink bowl 214, insofar as the composite edge 220 forms an interior boundary of the countertop 202. To this end, the intermediate collar 222 may include one or more blocks, bars or other bands configured to follow the interior border of the countertop 202. As a result, the one or more block, bars, or other bands may be curved to match the curvature of the opening 218 in the countertop 202.

Figure 8:
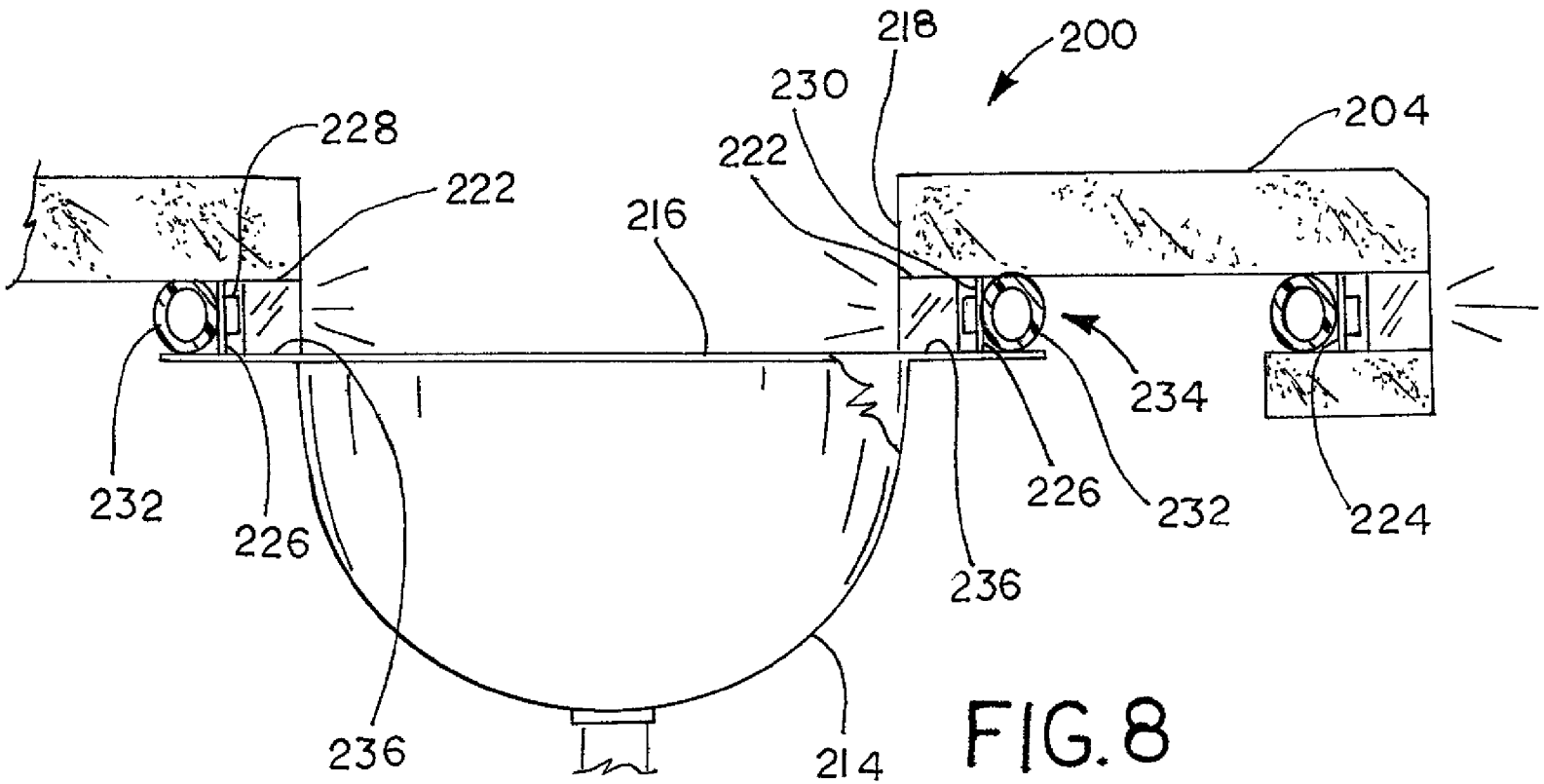
FIG. 8 is a cross-sectional view of the sink counter of FIG. 7 taken along the line 8-8 in FIG. 7.

Turning to FIG. 8, the counter 200 is shown in cross-section to depict the lighting arrangement along the interior and exterior borders of the example. An outer light source 224 is positioned along the exterior border and may be configured in a manner similar to the examples described above. In this example, an interior light source 226 is positioned along the interior border defined by the perimeter 216 of the sink 214 and the opening 218 in the top layer 204. The operation of the light sources 224, 226 may be directed independently via, for instance, separate controllers, or be directed by a single controller as a collective group. The interior light source 226 may include a number of lighting elements 228 (e.g., LEDs) mounted on a ribbon or strip 230 as described above. In that case, the strip 230 may wrap around the inner side of the one or more blocks, bars or other bands that form the intermediate collar 222. The strip 230 is held in place against the inner side of the intermediate collar 222 by a seal 232 as described above. In this case, a channel 234 to capture the seal 232 is formed between a flange 236 of the sink 214 and the countertop 202. Thus, the flange 236 forms a shelf for the intermediate collar 222, the strip 230, and the seal 232 in a manner similar to the base support bands described above.

As schematically illustrated in FIG. 8, the light emitted from the interior boundary by the above-described lighting arrangement may be directed both upward and downward in addition to the primary lateral direction through the intermediate collar 222. For instance, direction of the light downward into the sink bowl may be accomplished through the alteration or treatment of the surfaces adjacent the intermediate collar 222 as described above. Also, when not illuminated, the intermediate collar 222 may not be readily discernable due to the stacked layer arrangement along the interior boundary.

The under-mount sink bowl 214 may be secured to the other components of the counter 200 in a variety of ways. In one example, the flange 236 of the sink bowl 214 is adhesively or otherwise adhered to a bottom surface of the collar 222, which, in turn, may be adhered or attached to the countertop 204 with any desired fastener. In this sense, the flange 236 of the sink bowl 214 acts as a base for the collar 222. The adhesive may also form a watertight seal to protect the light source 226 from the water present in the sink bowl 214. Alternatively or additionally, the flange 236 may be secured to the countertop 204 by a number of clamps, brackets or other fasteners (not shown), thereby securing the sink bowl 214 and the collar 222 in place.

Figure 9:
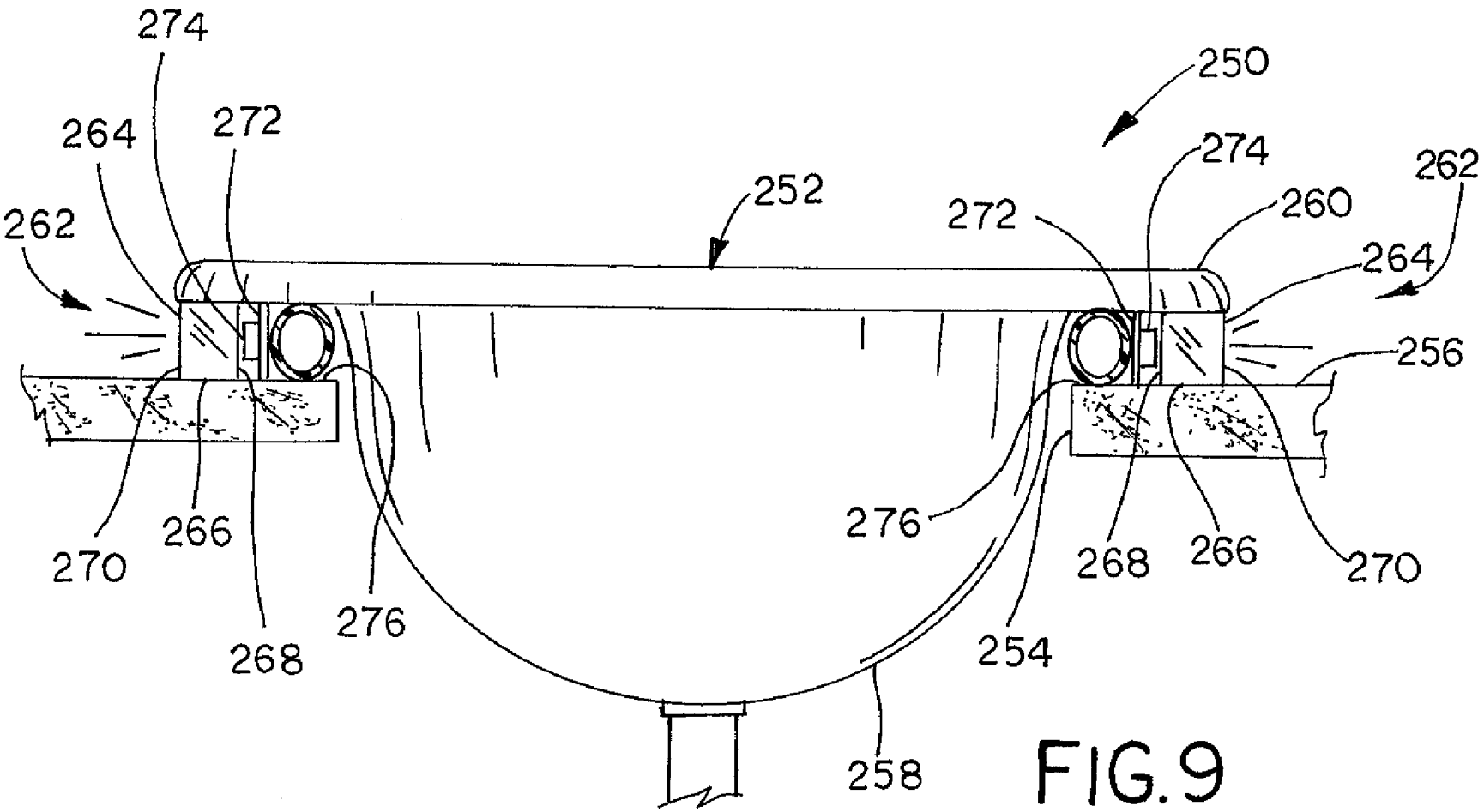
FIG. 9 is a cross-sectional view of an alternative sink counter arrangement with border lighting for a drop-in sink.

FIG. 9 shows a fragmented cross section of another example of a counter 250 with a sink 252 disposed in an opening 254 of a countertop slab 256. In this example, a sink bowl 258 is disposed in the opening 254 in a "drop-in sink" configuration. To that end, the sink 252 has a rim 260 extending outward from the bowl 258 to support the sink 252 within the opening 254. As in the sink example described above, the counter 250 has a stratified edge 262 defined at the interface between the countertop slab 256 and the sink 252. In this case, the stratified edge includes an intermediate collar 264 disposed or sandwiched between the rim 260 and the countertop slab 256. In this example, the countertop slab 256 serves as a base for the intermediate collar 264 and the rim 260 of the sink 252. Similar to the previously described examples, the intermediate collar 264 bears the weight of the sink 252 as the rim 260 rests upon the collar 266.

The collar 264 includes one or more light-transmissive bands 266 with an inner side 268 and an outer side 270 through which light from a light source 272 passes. The light source 272 may include any number of lighting elements 274 disposed on a strip or ribbon in a manner similar to that described above. In this example, the countertop slab 256 extends beyond the rim 260 to form a shelf 276 upon which the light source 272 and any related components (e.g., seal) may rest. As described above, the shelf 276 forms a channel with the top layer, in this case, the rim 260, in which the light source 272 is captured.

Described above are a number of examples of counters in which a stratified outer edge or border is configured with one or more light sources to support the emission of light outward through the edge or border. The outer edge or border may be along an interior boundary of the counter, as with a sink, or along an exterior boundary of the counter. The disclosed counters are well-suited for use with a variety of different counter configurations and applications, as well as any type (e.g., material), thickness, cut, or shape of countertop.

While the present invention has been described with reference to specific examples, which are intended to be illustrative only and not to be limiting of the invention, it will be apparent to those of ordinary skill in the art that changes, additions and/or deletions may be made to the disclosed embodiments without departing from the spirit and scope of the invention.

The foregoing description is given for clearness of understanding only, and no unnecessary limitations should be understood therefrom, as modifications within the scope of the invention may be apparent to those having ordinary skill in the art.

What is claimed is:

1. A counter comprising:

a base;

a countertop spaced from the base and having an edge that defines a border of the countertop;

an edge collar disposed between the base and the countertop, the edge collar including a light-transmissive band that extends along the border of the countertop, the light-transmissive band having an inner side and an outer side opposite the inner side that forms a stratified outer edge with the edge of the countertop; and a light source positioned adjacent the inner side of the edge collar and configured to emit light outward through the light-transmissive band;

wherein the base includes a support band that extends along the border of the countertop, the support band having an outer side that forms a bottom layer of the stratified outer edge, and wherein the support band, the edge collar, and the countertop are layered relative to one another such that the support band and the edge collar provide weight-bearing support for the countertop.

2. The counter of claim 1, wherein the outer side of the light-transmissive band and the edge of the countertop are arranged such that the stratified outer edge has a flush surface.

3. The counter of claim 1, wherein the base includes a cabinet wall on which the edge collar rests.

4. The counter of claim 1, wherein the light source includes a plurality of light elements spaced apart along the inner side of the light-transmissive band.

5. The counter of claim 4, wherein the light source further includes a strip on which the plurality of light elements are carried.

6. The counter of claim 4, further comprising an elongated seal that secures the plurality of light elements against the inner side of the light-transmissive band.

7. The counter of claim 1, wherein the base extends inward beyond the inner side of the light-transmissive band to form a channel between the countertop and the base in which the light source is disposed.

8. The counter of claim 1, wherein the light-transmissive band includes an elongated glass block disposed between the base and the countertop.

9. The counter of claim 1, wherein the light-transmissive band is sandwiched between the countertop and the base.

10. The counter of claim 1, wherein the light-transmissive band supports the countertop.

11. The counter of claim 1, wherein the support band and the countertop are formed from a same material.

12. A counter comprising:

a lower layer;

an upper layer spaced from and overlapping the lower layer, the upper layer having an edge that defines a border of the upper layer;

a support collar disposed between the lower and upper layers, the support collar including a light-transmissive band that extends along the border of the upper layer to space and support the upper layer above the lower layer, the light-transmissive band having an inner side and an outer side opposite the inner side that forms a stratified outer edge with the edge of the upper layer; and a light source positioned adjacent the inner side of the support collar and configured to emit light outward through the light-transmissive band;

wherein the lower layer includes a support band that extends along the border of the upper layer, the support band having an outer side that forms a bottom layer of the stratified outer edge, and wherein the support band and the support collar provide weight-bearing support for the upper layer.

13. The counter of claim 12, further comprising a countertop that forms the upper layer.

14. The counter of claim 13, wherein the outer side of the light-transmissive band and the edge of the upper layer are arranged such that the stratified outer edge has a flush surface.

15. The counter of claim 12, wherein the base includes a cabinet wall on which the support collar rests.

16. The counter of claim 12, wherein the light source includes a plurality of light elements spaced apart along the inner side of the light-transmissive band.

17. The counter of claim 16, wherein the light source further includes a strip on which the plurality of light elements are carried.

18. The counter of claim 16, further comprising an elongated seal that secures the plurality of light elements against the inner side of the light-transmissive band.

19. The counter of claim 12, wherein the light-transmissive band includes an elongated glass block disposed between the lower and upper layers.

20. The counter of claim 12, wherein the light-transmissive band is sandwiched between the lower and upper layers.

21. The counter of claim 12, wherein the support band and the upper layer are formed from a same material.

22. A counter comprising:

a lower layer;

an upper layer spaced from and overlapping the lower layer, the upper layer having an edge that defines a border of the upper layer;

a support collar disposed between the lower and upper layers, the support collar including a light-transmissive band that extends along the border of the upper layer to space and support the upper layer above the lower layer, the light-transmissive band having an inner side and an outer side opposite the inner side that forms a stratified outer edge with the edge of the upper layer;

a light source positioned adjacent the inner side of the support collar and configured to emit light outward through the light-transmissive band;

a countertop that forms the lower layer; and a drop-in sink having a rim that forms the upper layer.

23. A counter comprising:

an under-mount sink including a bowl and a flange extending outward from the bowl;

a countertop having an edge defining an opening in which the bowl of the under-mount sink is disposed;

an intermediate collar disposed between the flange and the countertop, the intermediate collar including a light-transmissive band that extends along the opening of the countertop, the light-transmissive band having an inner side and an outer side opposite the inner side that forms a stratified edge with the edge of the countertop; and a light source positioned adjacent the inner side of the intermediate collar and configured to emit light through the outer side of the light-transmissive band;

wherein the flange forms a shelf on which the intermediate collar and the light source are disposed.

24. The counter of claim 23, further comprising an elongated seal that secures the light source against the inner side of the light-transmissive band, wherein the flange and the countertop define a channel in which the light source and the elongated seal are captured.

* * * * *